United States Patent [19]

Smart

[11] 4,356,890

[45] Nov. 2, 1982

[54] METHOD FOR INSTALLING AN ELEVATOR SYSTEM

[76] Inventor: Gerald D. Smart, 10240 Benton St., Broomfield, Colo. 80020

[21] Appl. No.: 174,670

[22] Filed: Aug. 1, 1980

[51] Int. Cl.[3] ..... B66B 9/00

[52] U.S. Cl. ..... 187/6; 187/95; 29/429; 52/745

[58] Field of Search ..... 187/1 R, 2, 6, 95, 9 R; 182/36, 38, 39, 178, 82; 52/745, 741, 122, 30; 29/429, 428

[56] References Cited

U.S. PATENT DOCUMENTS

| | | | |
|---|---|---|---|
| 493,139 | 3/1893 | Wilson | 187/95 |
| 504,576 | 9/1893 | Gregory | 187/6 |
| 708,838 | 9/1902 | Sterlozza | 187/6 |
| 2,408,759 | 10/1946 | Dunlop | 187/6 |
| 2,708,012 | 5/1955 | Talcott | 29/429 |
| 3,302,749 | 2/1967 | Heaphy et al. | 182/82 |
| 3,656,580 | 4/1972 | Gostling | 182/178 |
| 3,851,736 | 12/1974 | Westlake | 29/429 |
| 3,893,219 | 7/1975 | Davis | 29/429 |
| 4,231,148 | 11/1980 | Harding | 52/745 |

*Primary Examiner*—F. J. Bartuska
*Assistant Examiner*—Kenneth Noland
*Attorney, Agent, or Firm*—Robert C. Dorr

[57] ABSTRACT

A method for installing an elevator system on a wall of an elevated structure having a plurality of rail mast sections and an elevator car. The method includes the steps of raising a first rail mast section upwardly off of the ground by a distance substantially equal to the length of the rail mast section, affixing the upper end of the next rail mast section to the bottom end of the first rail mast section, then repeating the above two steps until a desired number of rail mast sections are affixed. The assemblage of rail mast sections are then raised substantially equal to the height of the elevator car and the elevator car is placed under the raised assemblage of sections, the assemblage of raised mast sections are then lowered into the elevator car. Finally the assemblage of rail mast sections interconnected with the elevator are raised and the final three rail mast sections are attached to the wall and to the raised assemblage. The remaining rail mast sections are then affixed to the wall of the structure by selectively operating the elevator car as it travels up the assembled rail mast sections.

2 Claims, 13 Drawing Figures

METHOD FOR INSTALLING AN ELEVATOR SYSTEM

FIELD OF THE INVENTION

This invention relates to the field of erecting exterior elevator systems for use on elevated structures. In particular, the invention also relates to a method for installing elevator mast sections to the exterior wall of a structure.

BACKGROUND OF THE INVENTION AND PRIOR ART

Exterior elevator systems are commonly used in the construction of new buildings and on elevated smoke stacks for maintenance purposes.

In FIG. 1 is set forth an illustration of a common prior art approach for installing exterior elevator systems to a slanted wall (2–3 degrees) smoke stack. Typically, three mast sections 100 are mounted to the wall or side 110 of a smoke stack 120. The first three sections are mounted onto a base plate 102 and are plumbed and affixed to each other and then affixed to the wall 110. An elevator car 130 is mounted to the three mounted rail sections 100 by taking the bottom of the elevator 130 off, lifting it up and over the three installed rail mast sections by means of a crane or cherry picker (not shown) and then dropped over the rail and lowered onto the base plate. The elevator car 130 is then reassembled and a temporary platform 140 is built on top of the car 130 and electrical connections are attached thereto. The remaining rail mast sections generally designated as stack 150 are then lifted into position by means of a pully or whip system 160 having a wire rope 162. After installing nine to ten rail mast sections, the car 130 can be used to provide the hoisting power.

One major disadvantage of the approach shown in FIG. 1 is the time required to erect the rail mast sections. Typically only one section is hoisted to the temporary platform. The elevator car is then activated to travel upwardly to the upper end of the assembled sections. That carried section is then installed to the lower sections and to the wall. The car then travels down the assembled rail sections to receive and to carry the next rail mast section up. As it travels down it hoists the next section. Significant time elapses for traveling up and down the smoke stack. Hence, back charges or penalties incurred for installation delays (not only for the installation of the elevator system, but also for other crafts) may be significant. Because of the slow installation time, the structure poses a hazard as airplane strobe lights and lightening rods are not rapidly installed. Contraiwise, the present invention provides a method of installation which significantly speeds up construction time.

Another major disadvantage of the approach shown in FIG. 1 resides in the use of a temporary platform 140 which is constructed on top of the elevator car. Lifting rail mast sections to the temporary platform may result in an unsafe condition such as dropping tools or materials. Indeed, receiving the rail mast section on the platform and then installing it to the structure incurs a number of possible hazardous situations such as falling from the platform. On the other hand, the present invention does not require the construction of a temporary platform, nor the necessity of having personnel work at high levels.

Another disadvantage of the prior art approach is the lack of straightness of the finally installed rail sections vertically along the smoke stack which may result in crooked or ill-fitting joints between the sections. Such crooked joints cause a clicking noise as the elevator passes over, a rougher ride, and the possibility that the overspeed safety devices may not properly set. In the present invention, the creation of ill-fitted joints are substantially minimized since the force of gravity aligns along assembled rail mast sections. As another feature, the present invention does not cause weakening of the walkway supports as found in the prior approach where the hole in the walkway must be dimensionally fitted to receive the elevator system.

No prior approach utilizing the method of the present invention to erect rail mast sections to the wall of a structure is known to exist. The present invention offers an approach that is low in cost, safe, and one that can be easily installed. The practice of the present invention is not limited to use on smoke stacks, but is applicable to any elevated structure.

OBJECTS OF THE INVENTION

It is an object of the present invention to provide a new and novel method of installing an elevator system on the exterior of the wall of an elevated structure.

It is another object of the present invention to provide a new and novel method for installing an elevator to the exterior of an elevated structure by primarily installing the elevator system while standing on the ground.

It is another object of the present invention to provide a new and novel method of installing an elevator system to the exterior of an elevated structure by selectively interconnecting individual rail mast sections at ground level by selective hoisting of the assembled section.

SUMMARY OF INVENTION

The present invention for installing an elevator system on the wall of an elevated structure utilizes a sheaved mechanism placed on top of the structure at a point above the desired elevated position for the finally installed rail mast section, a wire rope interconnected through the sheaved mechanism to a power hoist and wherein the free end of the wire rope is then connected to the upper end of a first rail mast section. The first rail mast section is selectively lifted off the ground a distance substantially equal to the length of the section through activation of the power hoist. The next rail mast section is oriented into position below the raised section and the upper end is affixed to the bottom end of the raised mast section. These steps are repeated until each successive rail mast section is attached to the uplifted assemblage of connected rail mast sections. The assemblage of rail mast sections are then raised to a height slightly above the height of the elevator car and the elevator car is oriented directly underneath. The raised sections are lowered into the elevator car so that the elevator car operatively interconnects. The brakes are then set on the car and the assemblage of rail mast sections and the elevator car are lifted upwardly by the power hoist a predetermined distance. The remaining rail mast sections are then installed and firmly affixed to the wall of the structure and in the proper orientation. The mounted rail sections are then interconnected to the raised assemblage of rail sections and the elevator car is lowered. The elevator car is then selectively operated to travel upwardly to each next higher rail section which is then selectively anchored to the wall of the structure.

DETAILED DESCRIPTION OF THE PREFERRED EMBODIMENT

Figure 4:
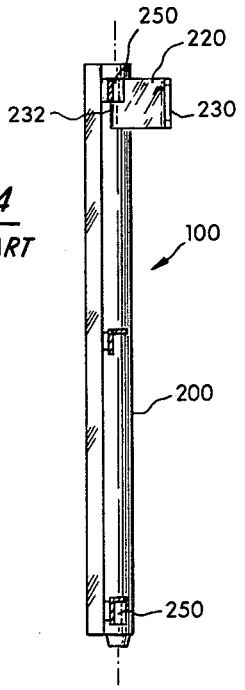
Fig. 4 PRIOR ART
FIG. 4 is a side planar view of the prior art rail mast section shown in FIG. 2.
Figure 2:
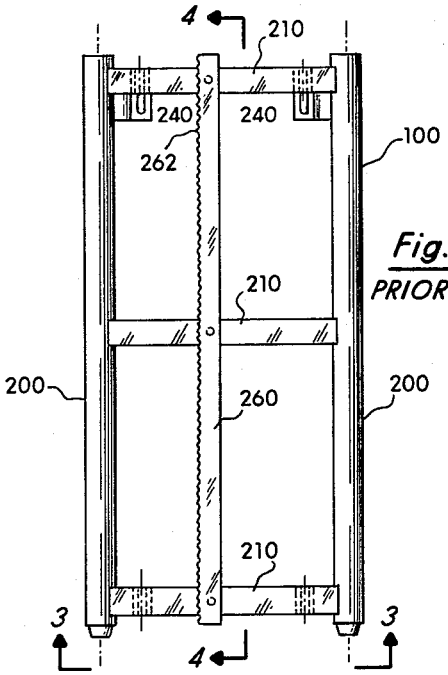
Fig. 2 PRIOR ART
FIG. 2 is a front planar view of a conventional prior art rail mast section.
Figure 3:
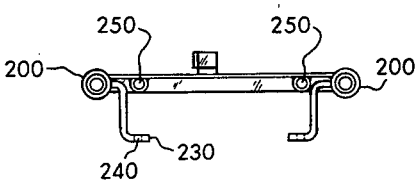
Fig. 3 PRIOR ART
FIG. 3 is a top planar view of the prior art rail mast section shown in FIG. 2.

In FIGS. 2 through 4 are shown the details of a conventional rail mast section 100. The rail mast section 100 includes two pipe sections 200 which are parallel to each other on opposing ends of the mast section 100. Disclosed at three places between the two pipes 200 are horizontal brackets 210 perpendicular to the pipes 200. Affixed to the uppermost bracket 210 are two rearwardly extending feet designated 220. Disposed inwardly toward each other are two ears 230 and disposed in the ears 230 are formed holes 240. Disposed on the upper and lower brackets 210 are two sleeves 250. A rectangular bar 260 having a rack 262 is disposed and affixed to the brackets 210 parallel to the pipes 200.

The rail mast section shown in FIGS. 2 through 4 is conventionally made such as from Linden-Alimak Corporation from Sweden. Typical dimensions on each rail mast section 100 are approximately five feet high by two and one-half feet wide.

Figure 5:
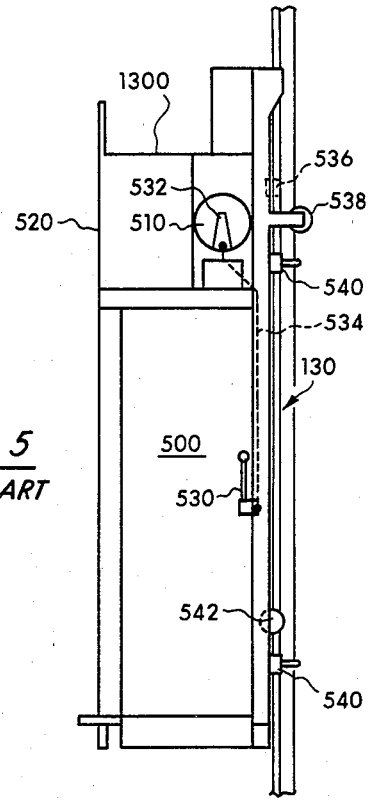
Fig. 5 PRIOR ART
FIG. 5 is a side planar view, in illustration, of a conventional prior art elevator car.

In FIG. 5 is shown a conventionally available elevator car 130 having an opening 500, a power system 510 and a shell 520. The car 130 has a brake handle 530 which selectively operates by means of cable 534 and a motor brake 532. When operated the motor brake 532 brakes the car 130 firmly against the rail sections. A roller guide 538 rides along the back of the rail sections and a roller guide 542 rides in front of the sections. Safety hooks are provided around each pipe 200. The rack and pinion arrangement is generally shown at 536 as the drive system. The other operative details of the elevator car are not important for the teaching of the present invention. Such an elevator car is also commercially available also from Linden-Alimak.

Figure 6:
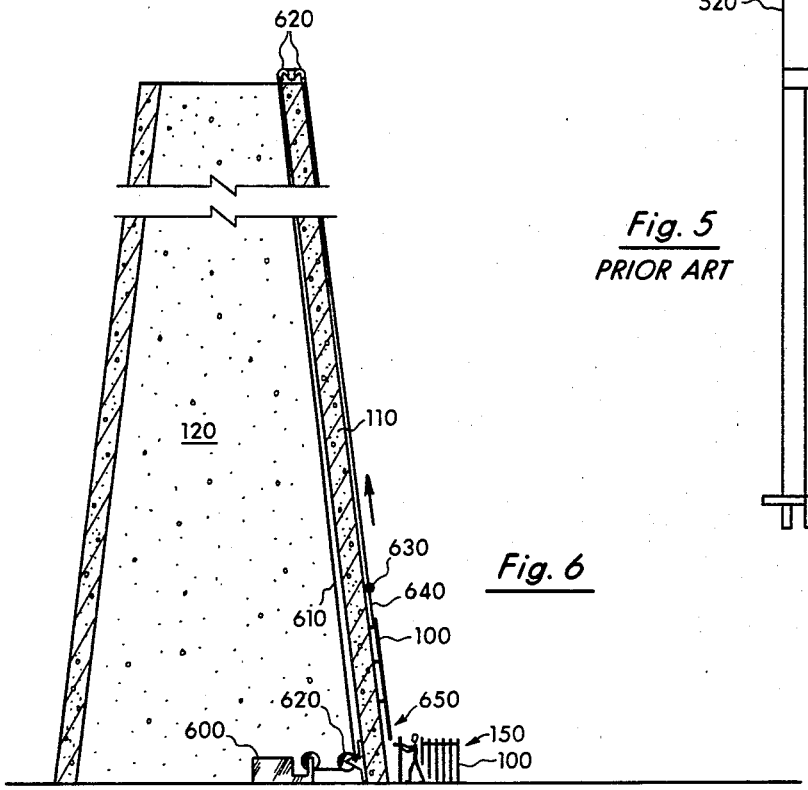
FIG. 6 is an illustration of the method of erecting an elevator system of the present invention to an elevated smoke stack.

The present invention is generally shown in FIG. 6 to include a power hoist 600, a wire rope 610, and a plurality of rail mast sections 150 comprising individual rail mast sections 100.

The power hoist 600 is connected to the wire rope 610 through a first sheave or snatch block 620 and the rope 610 runs inwardly along the inside of wall 110 up over the top of the smoke stack 120, over a pair of sheaves 620 and downwardly on the exterior surface of wall 110 being connected to a headache ball 630. The headache ball 630 is of sufficient weight to provide a counter veiling force to the cable 610 to hold the cable in position along the exterior wall 110. Connected to the headache ball 630 is a hook 640 which operates in the following fashion. The hook 640 is connected to a first upper rail mast section 100. In FIG. 6 the first rail mast section is connected to a second section which in turn is connected to a third section.

In operation, the power hoist 600 is activated to pull the interconnected assembly of rail mast sections, commonly designated 650, upwardly a sufficient distance so a next rail section 100 can be manually inserted, as shown in FIG. 6, and attached to the lower most rail mast section in the assembled stack 650. Once this rail section is assembled, the power hoist 600 is then activated to lift the entire assembly 650 up a sufficient distance to put the next rail mast section 100 on.

Figure 1:
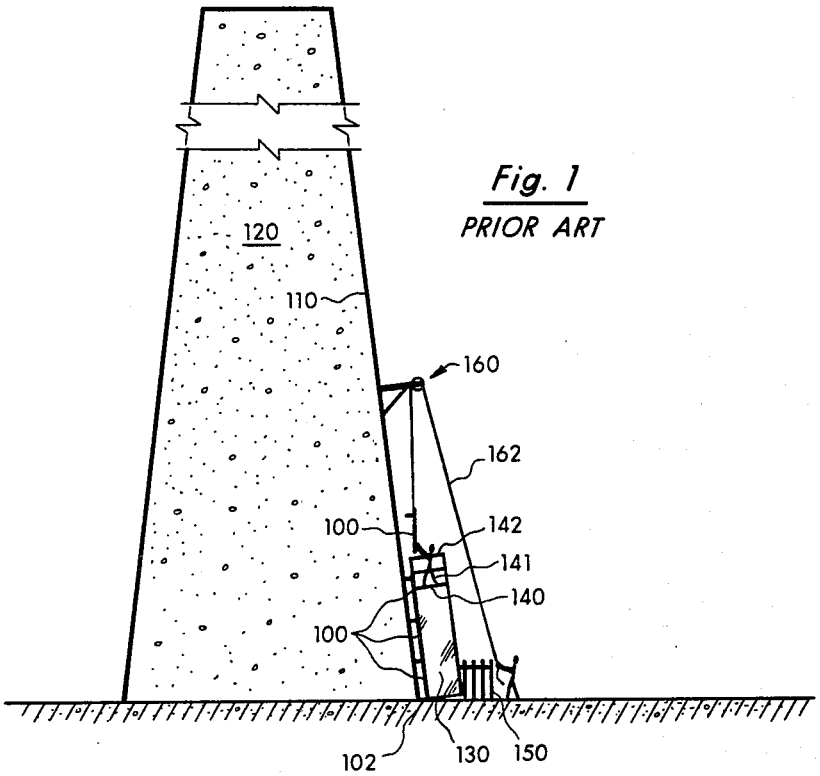
Fig. 1 PRIOR ART
FIG. 1 illustrates the prior art approach of erecting exterior elevator systems on an elevated smoke stack.

It can be readily observed that under the teachings of this invention, the rail mast sections 100 can be quickly and easily installed to each other without the necessity, as in the prior art approach shown in FIG. 1, of the elevator car riding up and down the rail system carrying a new section. This results in a significant time savings over the prior art approach. More importantly, the operator is primarily operating on the ground resulting in significant safety increase for the present invention. It is to be kept in mind that typically each of these sections weighs sbout 125 to 135 pounds.

The details of the present invention shown in FIG. 6 will now be elaborated on.

The power hoist 600 is conventional and can comprise any of a number of different types of power hoists presently commercially available. The use of a snatch block, which is also conventionally available, is optional and in the embodiment shown in FIG. 6 comprises a conventional sheave firmly affixed to the interior side of wall 110.

Figure 7:
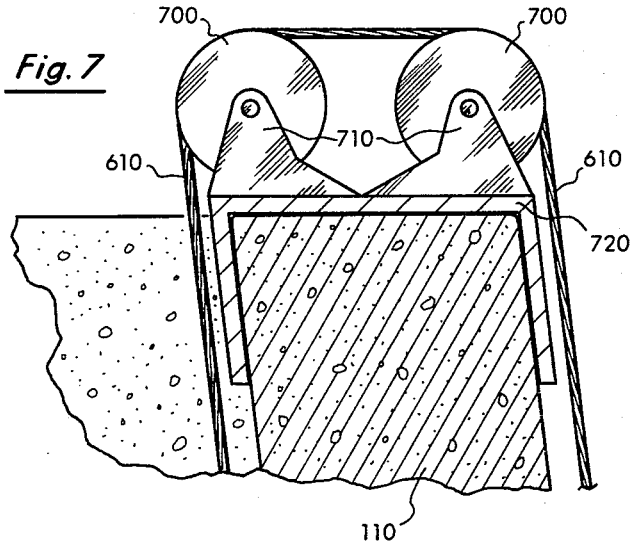
FIG. 7 is a side planar view, in partial cross section, of the upper sheaved mechanism of the present invention.

As shown in FIG. 7, mounted to the top of the smoke stack 620 is a sheaved mechanism 620 comprising two individual sheaves 700. The sheaves 700 are mounted by means of a bracket mount 710 to a base plate 720 which in turn is firmly and conventionally affixed to the top and opposing sides of wall 110 by means of concrete anchors and the like, not shown. The wire rope 610 is disposed over the sheaves 700 so that the direction of the wire rope is totally reversed with respect to opposing sides of wall 110.

Figure 8:
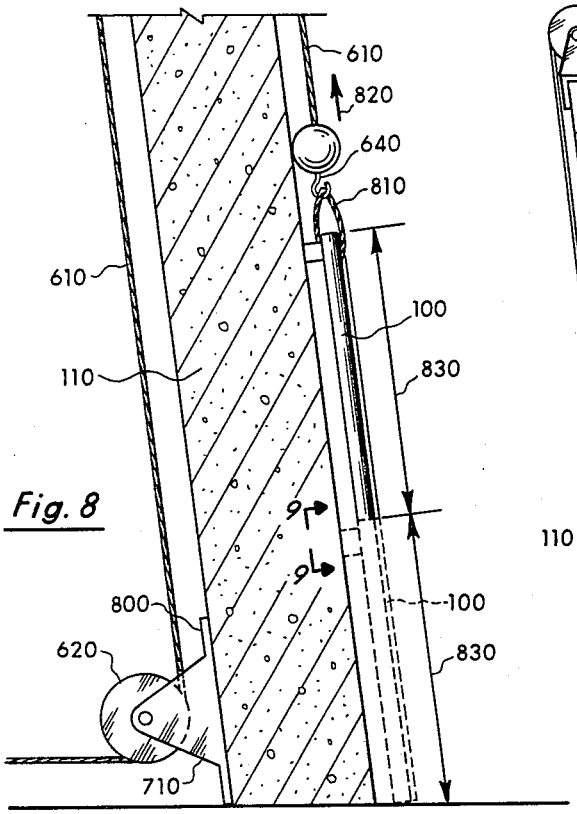
FIG. 8 is a side planar view, in partial cross section, of the lower snatch block and illustrating the step of raising a rail mast section upwardly.

In FIG. 8 the snatch block or sheave 620 is also shown mounted by means of mounting bracket 710 to a base plate 800 which in turn is conventionally affixed to the wall 110. Also shown in FIG. 8 are the details of the wire rope 610 connected to the headache ball 630 which carries hook 640. The hook 640 in turn hooks onto a chain or wire rope 810 which in turn is wrapped around the top of the upper most section rail mast section 100. As can be seen in FIG. 8, the first rail section 100 is lifted upwardly in the direction of arrow 820 substantially a distance which equals the length of a rail section designated by dimension 830. The next rail section, shown in dotted lines, is placed beneath the lifted rail section so it can be affixed thereto.

Figure 9:
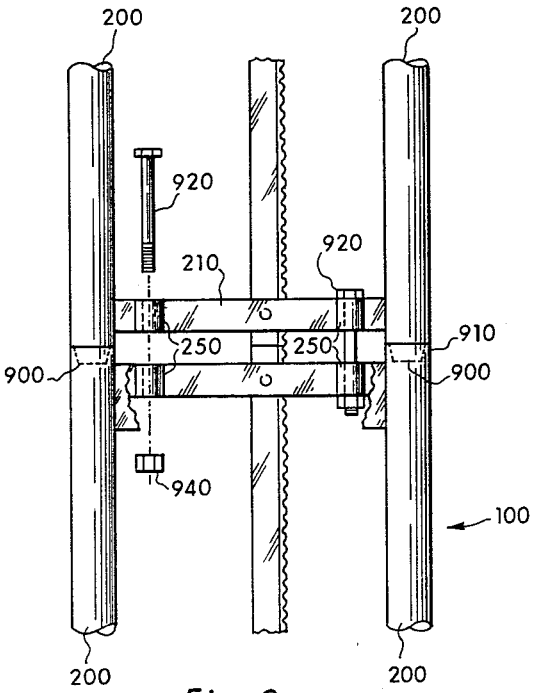
FIG. 9 is a front planar view illustrating the step of connection one rail mast section to another rail mast section.

In FIG. 9, the details of interconnecting two rail mast sections 100 together are shown. The bottom of the upper rail mast section tapers at the lower end 900 which tapered end is received by the upper end 910 of the lower rail mast section 100. In that orientation, bolts 920, typically one inch in diameter and ten inches long can be slid through the two opposing sleeves 250 on brackets 210 of the upper and lower rail mast sections 100. Once the bolts 920 are inserted, a nut 940 is used to firmly engage the upper and lower rail mast sections together.

Once two mast sections are interconnected, and in reference back to FIG. 6, the power hoist 600 is then activated to lift the assemblage 650 upwardly so that the next rail mast section 100 can be installed.

This process of selectively installing rail mast sections on the ground through selective activation of power hoist 600 continues until substantially all of the rail mast sections are installed. Preferably, the last remaining three rail mast sections are not installed in this fashion.

Figure 10:
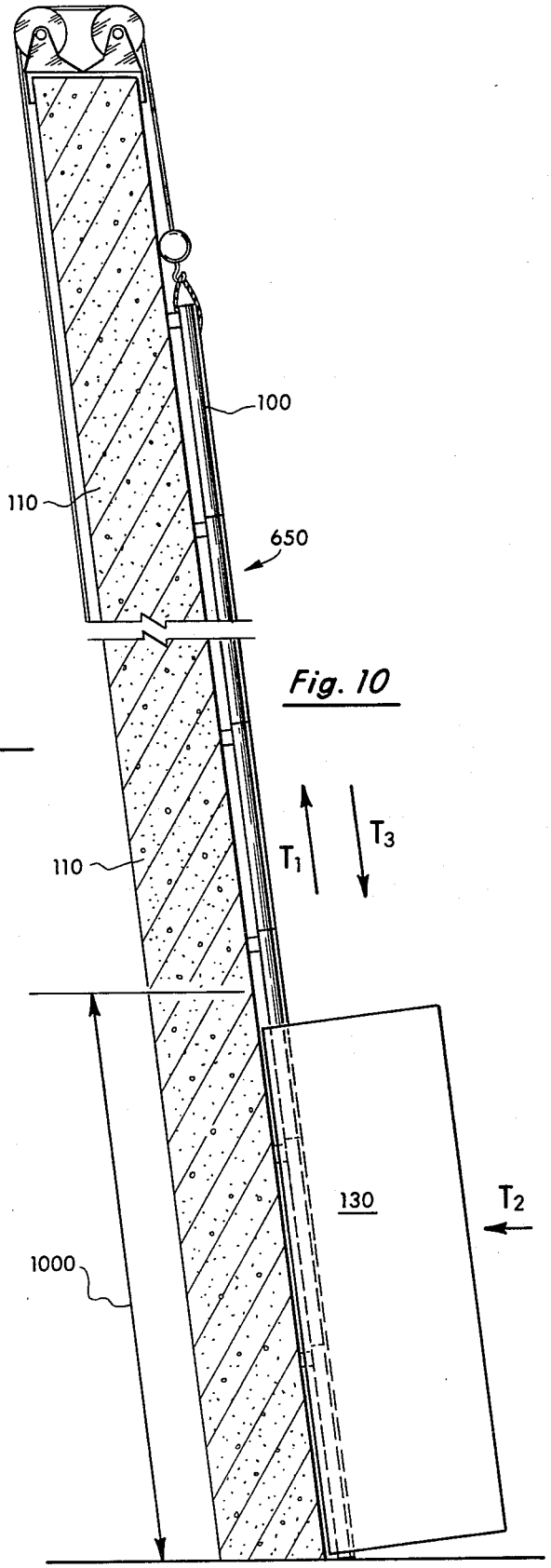
FIG. 10 is a side planar view, in partial cross section, illustrating steps of installing the elevator car.

Next, as shown in FIG. 10, the elevator car 130 is installed. This is accomplished by lifting the interconnected assemblage 650 of rail mast sections 100 upwardly a sufficient distance, designated 1000, which distance is greater than the height of the elevator car. In a typical situation, the elevator car is approximately 12 to 14 feet high. The elevator car is then maneuvered into position directly under the raised assembly 650. Once in position, the rail mast assembly 650 can be lowered into the elevator car. Unlike the prior art approach shown in FIG. 1, the elevator car 130 need not be partially disassembled since it merely slides into position. Once the lowered assembly 650 is lowered into place in the elevator car 130, in a conventional fashion, the brakes 530 of the elevator car 130 are activated.

In summary of FIG. 10, first the assemblage of rail mast sections 650 are lifted upwardly during Time $T_1$, next the elevator car 130 is placed in position under the raised sections 650 during time $T_2$, and finally the sections 650 are lowered into the elevator car during time $T_3$.

Figure 11:
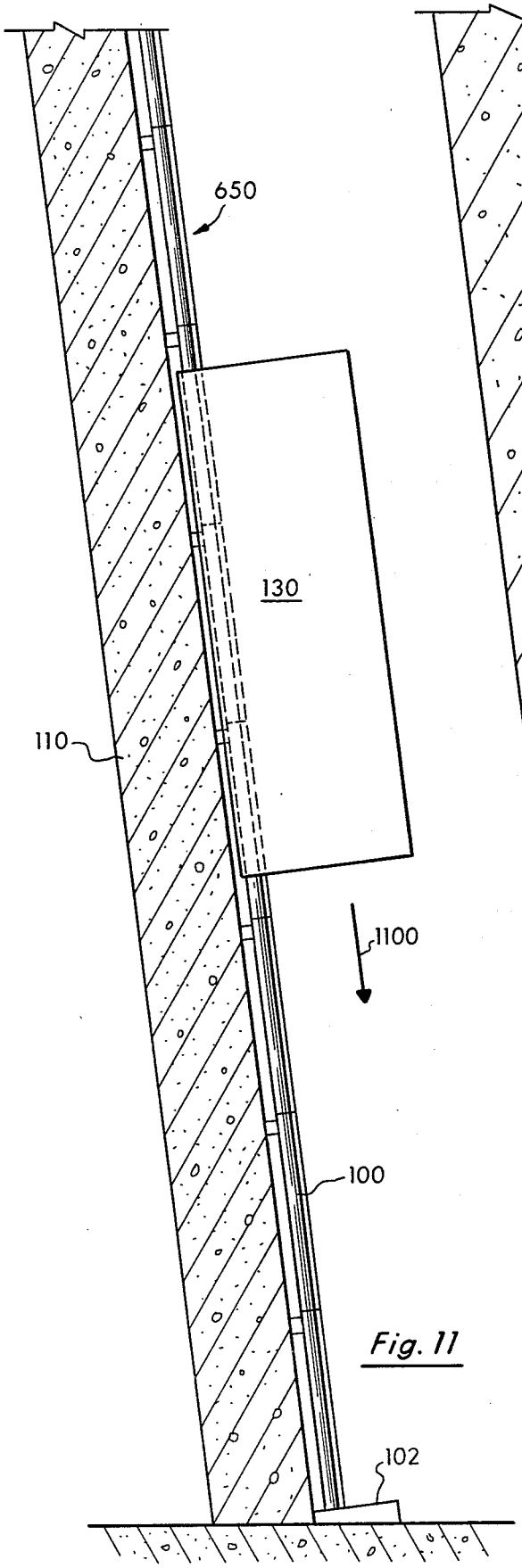
FIG. 11 is a side planar view, in partial cross section, illustrating the steps of installing the lower most rail mast section.

In FIG. 11, the lowermost three (in the preferred embodiment) rail mast sections 100 are conventionally installed under the raised assemblage 650 and the raised elevator car 130. This includes the installation of the base plate and the three lowermost sections not only to each other but also affixing each of the three to the wall 110 by means of an anchor cement screw 1200 illustrated in FIG. 12.

Figure 12:
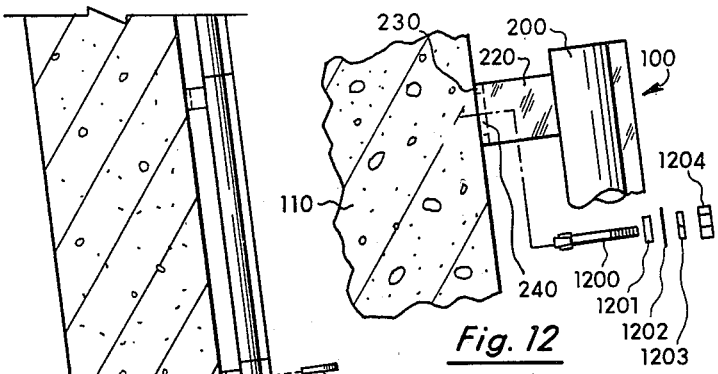
FIG. 12 illustrates the installation of the rail mast sections to the wall of the elevated structure.
Figure 13:
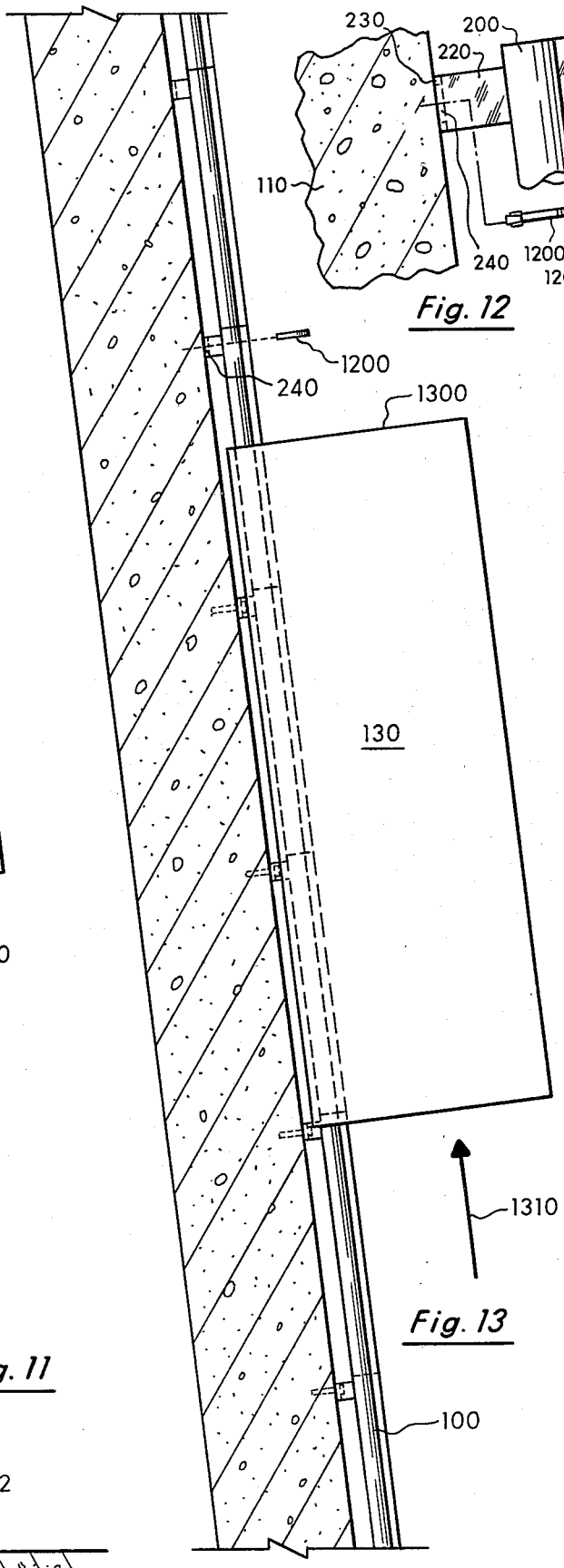
FIG. 13 is a side planar view, in partial cross section, illustrating the steps of installing the remaining rail mast sections to the wall of the structure.

In FIG. 12, the rail mast section 100 is mounted to wall 110 by means of cement anchor 1200, a sleeve 1201, a flat washer 1202, a lock washer 1203, and a nut 1204. In this fashion, the pipes 200 are offset from the wall 110 by the feet 220.

Hence in FIG. 11 and in summary, the next step involves the installation of the lowermost three rail mast sections 100 to each other and to the wall 110 directly under the raised assemblage 650 carrying the elevator car 130.

Once installed, the lowermost raised rail mast section is connected to the uppermost installed rail mast section, by the technique illustrated in FIG. 9. The elevator 130 is then lowered downwardly in the direction of arrow 1100.

The final installation of the elevator system now occurs. As shown in FIG. 12 the elevator car 130 is driven upwardly and a person (not shown) stands on the permanent platform 1300 of the elevator 130 and installs the remaining cement screws 1200 as the elevator 130 travels upwardly in the direction of arrow 1310. In this fashion, the rail mast sections 100 and the elevator 130 can be quickly and accurately installed on the sides of a structure 110.

The present invention contemplates a wire rope 610 having sufficient strength to safely hoist the assembled rail mast section 100 and the elevator car. In a typical example of a 600 foot tall smoke stack, one hundred rail mast sections 100 must be hoisted totaling approximately seven tons of weight including the weight of the elevator car.

When compared with the prior approach of FIG. 1, however, the speed in erection of the elevator system according to the teachings of the present invention offers a significant increase. For example, the prior art approach for a 600 foot tall structure would require approximately 100 separate trips up and down the structure an average round trip distance of 600 feet or a total of 60,000 feet. An elevator travels approximately 150 feet/minute. The total travel time is 400 minutes or approximately 6 hours of travel time. Under the teachings of the present invention this travel time is substantially eliminated.

While the present invention has been set forth in a preferred embodiment, it is to be expressly understood that changes in the method can be made without departing from the spirit or scope of the present invention as set forth in the following claims.

I claim:

1. A method for installing an elevator system on a wall of an elevated structure having a plurality of rail mast sections and an elevator car, said method comprising the steps of:

(a) raising the first rail mast section off the ground by a distance substantially equal to the length of said rail mast section, (b) affixing the upper end of the next rail mast section to the bottom end of the first rail mast section, (c) repeating steps (a) and (b) for each successive rail mast section until the first rail mast section is at the desired elevated position on the structure, (d) raising the affixed rail mast sections the height of the elevator car, (e) placing the elevator car under the raised rail mast sections, (f) lowering the rail mast sections into the elevator car so that the rail mast sections operatively interconnect with the elevator car, (g) raising the interconnected rail mast sections and elevator car, (h) mounting a predetermined number of rail mast sections to the structure and to each other, (i) interconnecting the lowermost rail mast section of said raised sections to the uppermost section of said mounted predetermined number of sections, and (j) mounting each interconnected rail section to the structure by selectively raising the elevator.

2. A method of installing an elevator system on a wall of an elevated structure having a plurality of rail mast sections and an elevator car, said method comprising the steps of:

(a) placing a sheaved mechanism on the structure at a point above the desired elevated position of the finally installed rail mast sections, (b) interconnecting one end of a wire rope through said sheaved mechanism to a power hoist, (c) connecting the free end of the wire rope to the upper end of a first rail mast section, (d) raising the first rail mast section off the ground by a distance substantially equal to the length of said rail mast section through selective activation of the power hoist, (e) affixing the upper end of the next rail mast section to the bottom end of the first rail mast section, (f) repeating steps (d) and (e) for each successive rail mast section until the first rail mast section is at the desired elevated position on the structure, (g) raising the affixed rail mast sections the height of the elevator car, (h) placing the elevator car under the raised rail mast sections, (i) lowering the rail sections into the elevator car so that the rail sections operatively interconnect with the elevator car, (j) raising the interconnected rail mast sections and elevator car, (k) mounting a predetermined number of rail mast sections to the structure and to each other, (l) interconnecting the lowermost rail mast section of said raised sections to the uppermost section of said mounted predetermined number of sections, (m) mounting each interconnected rail section to the structure by selectively raising the elevator, and (n) removing the wire rope and sheaved mechanism from the structure.

* * * * *